United States Patent [19]

Kellogg

[11] Patent Number: 4,566,502

[45] Date of Patent: Jan. 28, 1986

[54] WIRE-GUIDE LATCHING DEVICE FOR A WIRE-HARNESS ASSEMBLY FORM BOARD

[75] Inventor: James A. Kellogg, Thousand Oaks, Calif.

[73] Assignee: Lockheed Corporation, Burbank, Calif.

[21] Appl. No.: 626,347

[22] Filed: Jun. 29, 1984

[51] Int. Cl.[4] ..... B21F 3/00

[52] U.S. Cl. ..... 140/92.1; 269/903; 403/111; 403/328

[58] Field of Search ..... 140/92.1; 269/903, 77, 269/303; 248/509; 403/111, 113, 117, 146, 328; 24/530, 132 AA, 609

[56] References Cited

U.S. PATENT DOCUMENTS

| | | | |
|---|---|---|---|
| 2,542,567 | 2/1951 | Peters | 403/146 |
| 3,351,369 | 11/1967 | Hogstrom | 403/111 |
| 3,839,777 | 10/1974 | Puzio | 29/203 |
| 3,944,719 | 3/1976 | Rubey | 174/72 |
| 3,980,409 | 9/1976 | Turner | 403/328 |
| 4,009,852 | 3/1977 | Bulanda et al. | 248/68 |
| 4,029,277 | 6/1977 | Bulanda | 248/74 |
| 4,177,359 | 12/1979 | Naranjo | 179/98 |
| 4,337,934 | 7/1982 | Caveney | 269/77 |

*Primary Examiner*—Lowell A. Larson
*Assistant Examiner*—Linda McLaughlin
*Attorney, Agent, or Firm*—Louis L. Dachs

[57] ABSTRACT

The invention is a wire-guide latching device 22 for a wire-harness assembly form board 24. The device 22 comprises a first post 26 having first and second ends, with the first end coupled to the board and the second end terminating in a circumferentially disposed laterally extending flange 30. A second post assembly 32 is provided having first and second ends, with its first end coupled to the board 24 and incorporating a rotatable arm 52. The arm is rotatable from a first position wherein the arm's free end is in overlapping relationship with the flange 30 of the first post 26 to a second position out of engagement therewith and, further, moveable to a third position in the opposite direction from the second position. A detent system 80 is provided which is adapted to selectably hold the arm 52 in either the first or third positions. A spring 60 is provided which is adapted to bias the arm 52 to the first position when it is moved toward or into the second position.

2 Claims, 6 Drawing Figures

WIRE-GUIDE LATCHING DEVICE FOR A WIRE-HARNESS ASSEMBLY FORM BOARD

TECHNICAL FIELD

The invention relates to the field of wire-harness fabrication and, in particular, to a wire-guide latching device for aligning wires on wire-harness assembly form boards.

BACKGROUND ART

A wire harness typically comprises a multiwire main trunk with numerous multiwire branches all terminating in electrical connectors. In the assembling of a wire harness, each wire is typically laid up on a wiring-harness, "lay-up" form board between its desired termination points with the wire placed in a plurality of wire-guide devices. For example, U.S. Pat. No. 4,337,934, "Assembly Post" by J. E. Caveney, discloses a clamping device mounted on a form board which has jaws biased to the closed position in which the center of the jaws contain an elastic strap. Thus, when a wire is inserted into the jaws, the strap tends to force the wires together, forming a compact bundle. While this device has the advantage of automatically grouping the wires together, it does not lend itself to automated assembly in that an automatic wire-laying head would have difficulty placing a wire within the jaws of the individual clamps.

Also of interest is U.S. Pat. No. 4,177,359, "Post Wire Guide Latching Means" by George Naranjo. Naranjo discloses a wire-guide latching device for use with telephone cables. The latching device comprises a pair of posts with a snap-on cross arm which forms a channel for the wires. The arm can be rotated to open the channel. This particular device has drawbacks when considered for use in an automated wire-harness assembly system in that the cross arm is not spring-biased to a closed position, nor are there detent means to hold positions, since the arm is primarily being held in position by friction.

Other examples of wire-guiding devices for use on the assembly of wire harnesses are disclosed in U.S. Pat. No. 4,029,277, "Apparatus for Holding and Forming a Plurality of Objects into a Bundle" by J. J. Bulanda; U.S. Pat. No. 3,839,777, "Wire Harness Assembly" by E. T. Puzio; U.S. Pat. No. 3,944,719, "Wire Routing Apparatus" by U. R. Rubey and, finally, U.S. Pat. No. 4,009,852, "Corner Post Harness Assembly Apparatus" by J. J. Bulanda, et al.

None of these patents disclose a latching device for use on a wire-harness form board which allows the wire-dispensing head to move a spring-biased arm to an open position and allowing the wire to be placed in the channel, with the biasing means automatically returning the arm to its retracted position and, also, with a detent means for releasably holding the arm in the closed and open positions.

Therefore, it is a primary object of this invention to provide a wire-harness latching device for a wire-harness form board which is adapted to allow automated wire-harness layup.

Another object of the subject invention is to provide a latching device which provides for easy removal of the wiring harness from the form board after assembly.

It is still a further object of the subject invention to provide a latching device for use on a wire-harness fabrication form board which can accommodate both automated wire lay-up and manual wire lay-up procedures.

DISCLOSURE OF INVENTION

The invention is a wire-guide latching device for a wire-harness assembly form board. The device comprises a first post having first and second ends, with the first end coupled to the board and the second end terminating in a circumferentially disposed, laterally extending flange. A second post is provided, having first and second ends, with the first end coupled to the board and, at the second end, incorporating an arm having a free end rotatably mounted thereon and rotatable with the post. The arm is rotatable from a first position, wherein the arm's free end is in overlapping relationship with the flange of the first post to a second position out of engagement therewith and, further, moveable to a third position in a direction opposite to the second position. A detent means is provided which is adapted to selectably hold the arm in either the first or third position. A spring means is provided which is adapted to bias the arm to the first position when it is moved toward or into the second position.

The novel features which are believed to be characteristic of the invention, both as to its organization and its method of operation, together with further objects and advantages thereof, will be better understood from the following description in connection with the accompanying drawings in which a presently preferred embodiment is illustrated by way of example. It is to be expressly understood, however, that the drawings are for purposes of illustration and description only, and are not intended as a definition of the limits of the invention.

BRIEF DESCRIPTION OF DRAWINGS

Illustrated in FIG. 1 is a partial perspective view of an electrical wire-harness assembly form board with the subject latching devices installed thereon.

Illustrated in FIG. 2 is a partial perspective view of an individual latching device as shown in FIG. 1.

Figure 1:
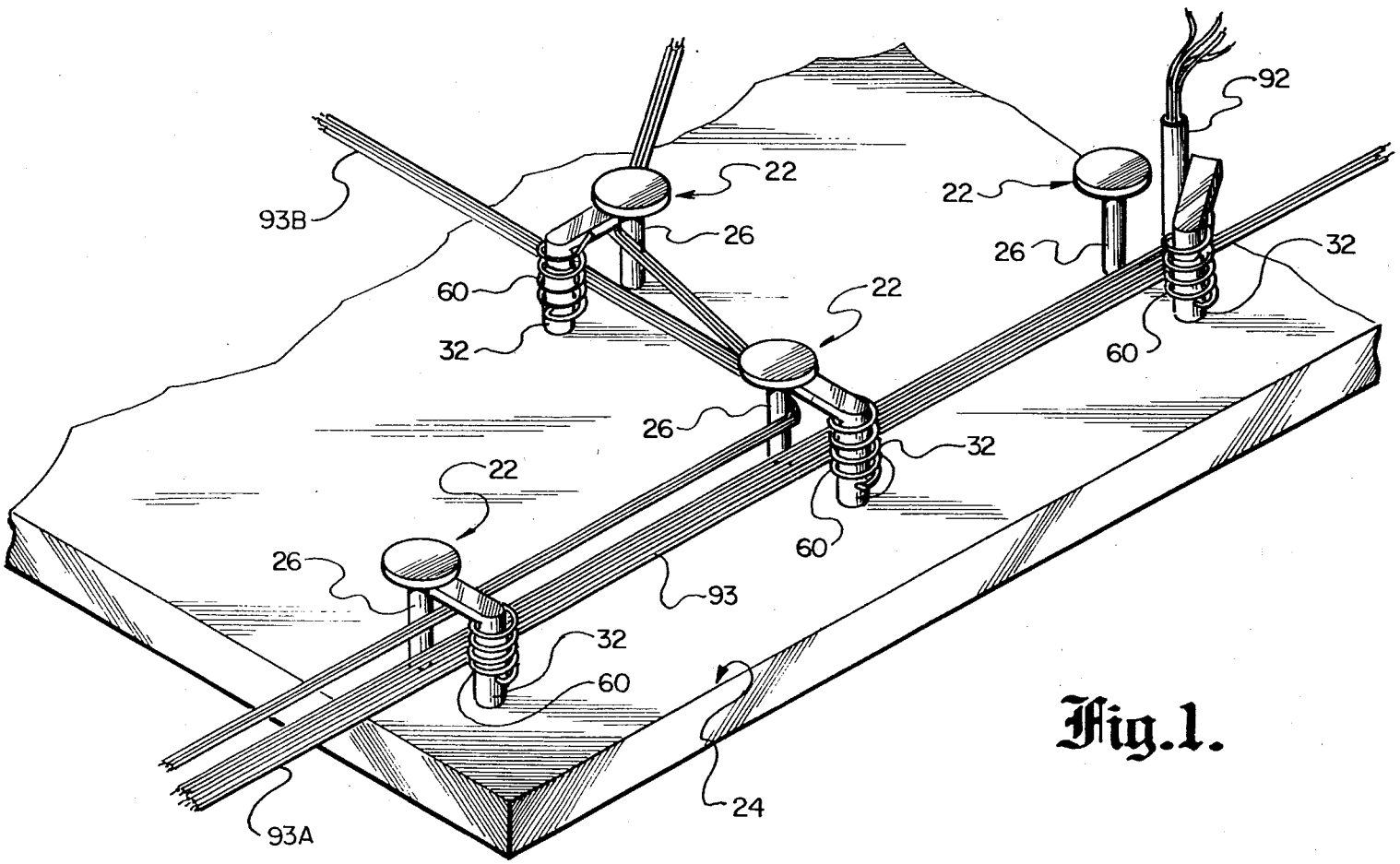
Figure 2:
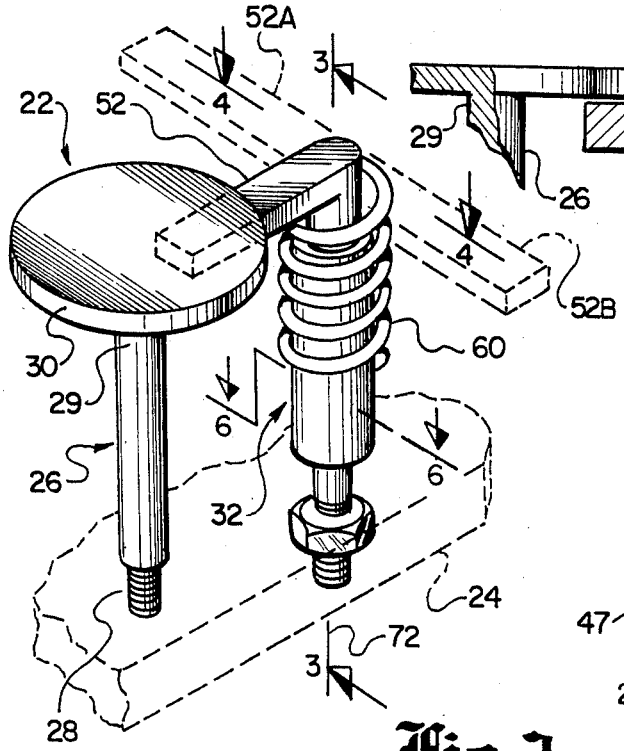
Figure 3:
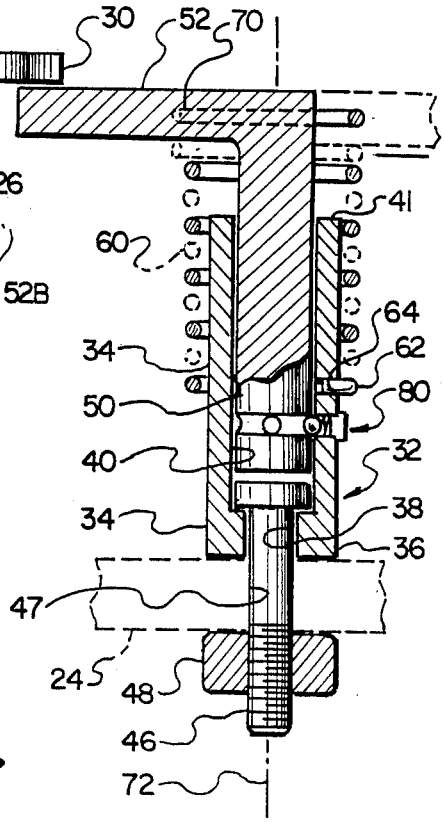

Illustrated in FIG. 3 is a partial cross-sectional view of the latching device illustrated in FIG. 2, taken generally along the line 3—3.

Figure 4:
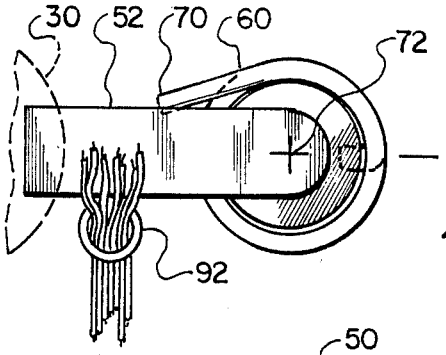

Illustrated in FIG. 4 is a view looking downward on the latch assembly as illustrated in FIG. 2 along the line 4—4.

Figure 5:
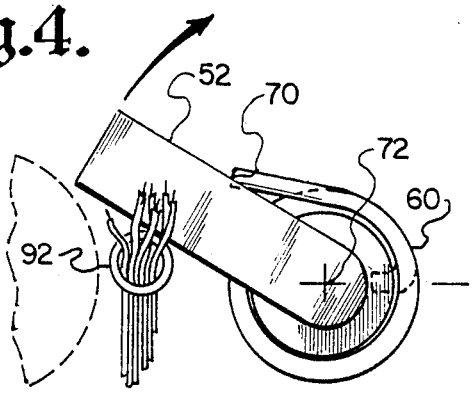

Illustrated in FIG. 5 is a view similar to that illustrated in FIG. 4, but showing a wire-dispensing probe moving the arm to the open position.

Figure 6:
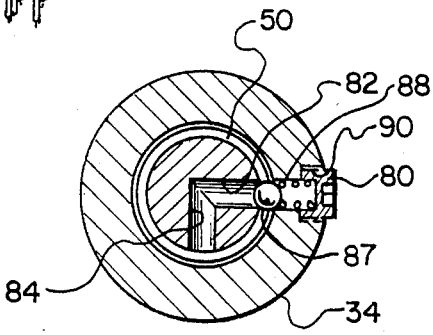

Illustrated in FIG. 6 is a cross-sectional view of the latching device illustrated in FIG. 2, taken along the line 6—6.

BEST MODE FOR CARRYING OUT THE INVENTION

Referring to FIGS. 1 through 6, it can be seen that the latching device, generally indicated by numeral 22, is mounted on a wire-harness assembly form board 24. The device 22 comprises a first post 26 threadably mounted by its first end 28 to the form board 24 and which terminates at its second end 29 in a circumferentially disposed laterally extending flange 30. A second post, or post assembly, generally designated by numeral 32, includes a hollow tubular member 34 having a first end 36 with a through hole 38 and a counterbore 40 extending to the opposite end 41. The tubular member 34 is fastened to the form board 24 by means of a threaded bolt 46 which extends through a hole 47 in the form board 24 and engages a nut 48. Rotatably mounted within the counterbore 40 is a shaft 50 having a laterally extending arm 52. A coil spring 60 is mounted about the post 32, having an inwardly directed detent end 62 engaging a hole 64 in the post 32 and a second end 70 in contact with one side of the arm 52. Thus, the shaft 50 is rotatable about the longitudinal axis 72 of the counterbore 40.

A detent system, best illustrated in FIG. 6, generally designated by numeral 80, is mounted within the second post 32 and the shaft 50. The detent system 80 comprises, in part, a pair of holes 82 and 84 in the shaft 50 at substantially right angles to each other. Mounted within the member 34 is a ball 87, spring biased toward the shaft 50 by means of a spring 88. Thus, when the arm 52 is in a first position, wherein the arm 52 is in an overlapping relationship with the flange 30 (best illustrated in FIGS. 2 and 3), the detent system 80 releasably holds the arm in that position (ball 87 engages hole 82). When moved clockwise to the open position (indicated by numeral 52A) by means of a wire-dispensing guide 92 (See FIGS. 1, 4, and 5), the detent force of the spring 88 is overcome, but the spring 60 will force the arm 52 back to its first position upon passage of the wire-dispensing guide 92 therethrough and, thus, the individual wire or groups of wires making up the wire-harness assembly 93 can be easily routed and "locked" in position. The spring 60 is positioned such that there is little or no force applied to the arm 52 when the arm is in the first position and such that a return force is only applied when the arm is moved toward the second position.

After the individual wires or groups of wires of the wire-harness assembly 93 are "layed up", the "trunk" portion 93A and individual "branch" portions, such as trunk 93B, are tied into bundles at appropriate distances along their lengths. Thereafter, the wire-latching device is opened to a third position (indicated by numeral 52B in FIG. 2) by rotating the arm 52 counterclockwise such that the detent 80 will hold the arm 52 in the third position (the ball 87 engaging hole 84) allowing removal of the completed wire-harness assembly therefrom. Thus it can be seen that the wire-guide latching device 22 with its automatic latching features can greatly speed up the assembly process while insuring that individual wires stay properly located along the length of the harness.

While the invention has been described with reference to particular embodiments, it should be understood that the embodiments are merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to automated, wire-harness fabrication.

I claim:

1. A wire-guide latching assembly for a wire-harness assembly forming board comprising:

a first post having first and second ends, said first end coupled to the board and said second end terminating in a circumferentially disposed laterally extending flange assembly;

a second post assembly having first and second ends, said first end coupled to the board and having an arm rotatably mounted to said second end, said arm having a free end rotatable from a first position, wherein said free end of said arm is in overlapping relationship with said flange assembly, to a second position free of said flange assembly and, further, moveable to a third position in the opposite direction of said second position, also free of said flange assembly;

a detent assembly mounted within said second post assembly releasably holding said arm in said first or third positions; and spring means having a first end coupled to said second post, and a second end in contact with said arm for biasing said arm to said first position when said arm is moved toward said second position.

2. The wire-guide latching assembly of claim 1 wherein said second post assembly comprises:

a hollow tubular member having first and second ends, said first end mounted to the board and said second end having a bore therein; and the end opposite said free end of said arm terminating in a shaft rotatably mounted in said bore.

* * * * *